US006986455B2

(12) United States Patent
Su

(10) Patent No.: US 6,986,455 B2
(45) Date of Patent: Jan. 17, 2006

(54) FILE FOLDER

(76) Inventor: Ken Jui Su, No. 180, Su Wang 1st Road, Da Li City, Taichung Hsien (TW) 412

( * ) Notice: Subject to any disclaimer, the term of this patent is extended or adjusted under 35 U.S.C. 154(b) by 285 days.

(21) Appl. No.: 10/446,975

(22) Filed: May 27, 2003

(65) Prior Publication Data

US 2004/0238606 A1 Dec. 2, 2004

(51) Int. Cl.
*B65D 27/00* (2006.01)

(52) U.S. Cl. ..... 229/67.1; 229/67.4

(58) Field of Classification Search ..... 229/67.1, 229/67.4; 281/28, 45; 24/67.11
See application file for complete search history.

(56) References Cited

U.S. PATENT DOCUMENTS

| | | | | |
|---|---|---|---|---|
| 4,904,104 | A | 2/1990 | Gloeckle | |
| 5,226,676 | A | 7/1993 | Su | |
| 5,285,952 | A | 2/1994 | Ho | |
| 5,639,016 | A * | 6/1997 | Ho | 229/67.4 |
| 5,692,670 | A * | 12/1997 | Ho | 229/67.1 |

* cited by examiner

*Primary Examiner*—Jes F. Pascua
(74) *Attorney, Agent, or Firm*—Charles E. Baxley

(57) ABSTRACT

A file folder includes a base sheet having two slits to form two ears, and a flap extended from the base sheet. A clip includes a base plate having two side portions engageable between the ears of the base sheet, and includes a clamping plate and a bow formed between the base plate and the clamping plate. The ears of the base sheet may guide the base plate of the clip to move relative to the base sheet, and to prevent the base plate from being disengaged from the base sheet. The middle portion of the base plate will not be engaged or blocked by the ears of the base sheet, to allow the clip to be easily moved forwardly and rearwardly relative to the base sheet.

2 Claims, 10 Drawing Sheets

FILE FOLDER

BACKGROUND OF THE INVENTION

1. Field of the Invention

The present invention relates to a file folder, and more particularly to a file folder having a structure for preventing a clip from being disengaged from the file folder inadvertently.

2. Description of the Prior Art

Typical file folders comprise a front sheet, a back sheet, a folder strip formed between the front sheet and the back sheet and foldable relative to the front sheet and the back sheet, to receive paper sheets between the front sheet and the back sheet. A clip is further provided and engaged onto the edge portions of the front sheet and the back sheet, to clamp and retain the paper sheets between the front sheet and the back sheet.

For example, U.S. Pat. No. 4,904,104 to Gloeckle discloses one of the typical file folders which also comprises a clip provided to clamp and retain the paper sheets between the front sheet and the back sheet. However, a long slit or cut is required to be formed in the folder strip to receive the clip, and the clip may not be easily engaged through or into the slit or cut of the folder strip. In addition, the folder strip may interfere with the operation of the clip.

The applicant has also developed a file folder which is disclosed in U.S. Pat. No. 5,226,676 to Su, and which comprises three foldable strips coupled to a base sheet. One of the strips that is located close to the base sheet includes an opening formed therein to receive the clip. However, the foldable strips may be easily curled and may not be retained in position. In addition, the foldable strips may also interfere with the operation of the retaining clip.

U.S. Pat. No. 5,285,952 to Ho discloses another typical file folder which comprises two slits perpendicular to the slit or cut as shown in Gloeckle, to slidably receive two protrusions extended from the clip, and which comprises two holes formed in the ends of each of the slits, to receive the protrusions of the clip.

However, when the clip is slid away from the file folder or when the clip is completely engaged onto the file folder, the protrusions of the clip will be aligned with the holes of the file folder, and will be easily disengaged from the file folder.

The present invention has arisen to mitigate and/or obviate the afore-described disadvantages of the conventional file folders.

SUMMARY OF THE INVENTION

The primary objective of the present invention is to provide a file folder including a structure for preventing a clip from being disengaged from the file folder inadvertently.

In accordance with one aspect of the invention, there is provided a file folder comprising a base sheet including a front portion, a rear portion, and two side portions, and including two slits formed in the rear portion thereof and spaced away from each other to form two ears, a flap extended from the rear portion of the base sheet, and including a folding line formed between the flap and the rear portion of the base sheet, to allow the flap to be folded relative to the base sheet, and a clip including a base plate having two side portions engageable through the slits of the base sheet, and arranged between the ears of the base sheet, and including a clamping plate, and a bow formed between the base plate and the clamping plate. The ears of the base sheet are engaged onto the side portions of the base plate of the clip, to guide the base plate of the clip to move forwardly and rearwardly relative to the base sheet, and to prevent the base plate from being moved laterally relative to the base sheet, and the base plate of the clip includes a middle portion arranged between the side portions thereof and between the ears of the base sheet, to allow the clip to be easily moved forwardly and rearwardly relative to the base sheet.

The clamping plate includes a front portion having a hook member provided thereon, the flap includes at least one cut formed therein to form at least one stop therein, and the stop is engageable with the clamping plate of the clip, to prevent the clip from being disengaged from the flap.

A cover sheet may further be provided or extended from the flap, or extended from the rear portion of the base sheet.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
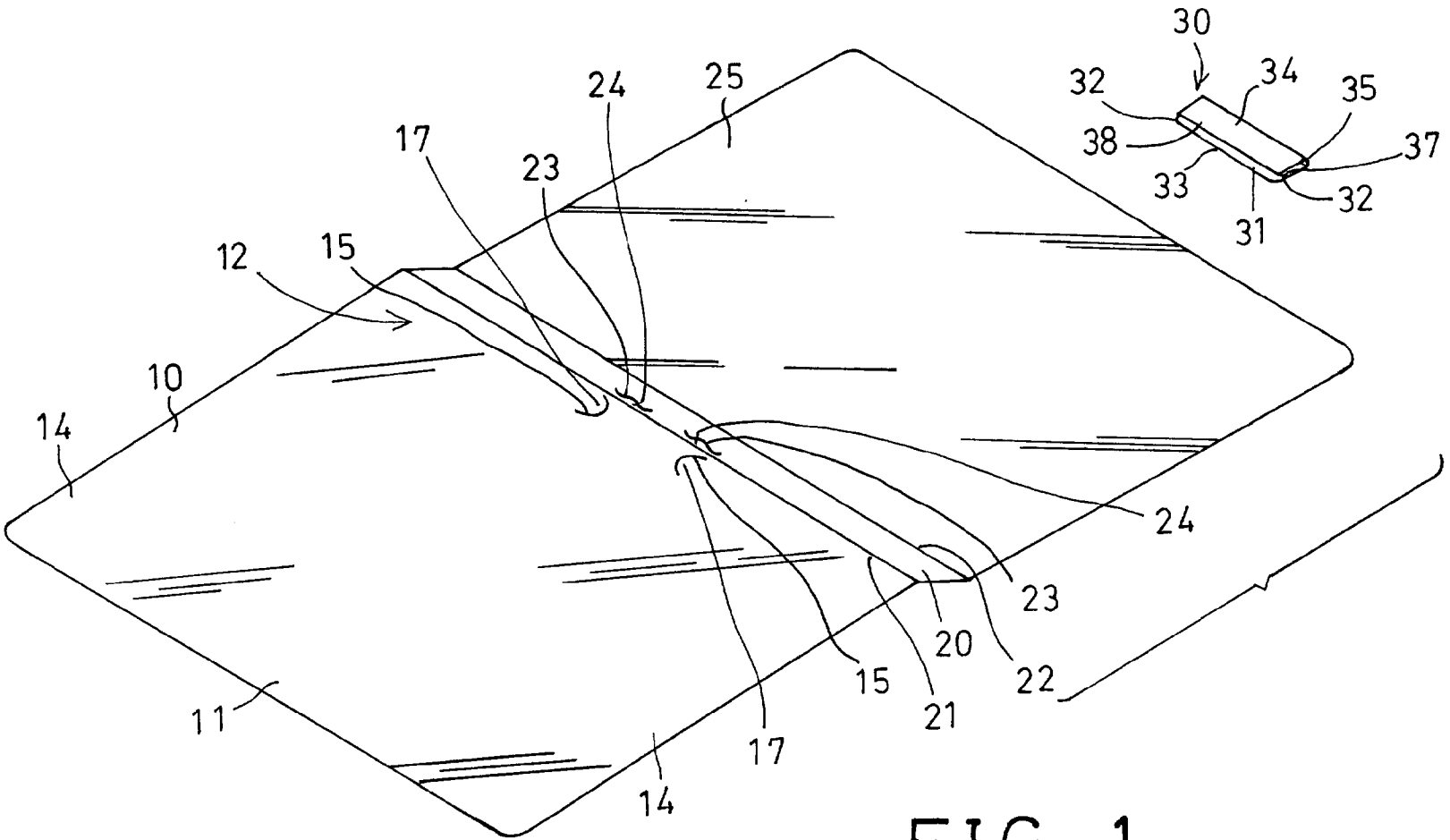
FIG. 1 is an exploded view of a file folder in accordance with the present invention, in which the file folder is arranged in an open position.
Figure 2:
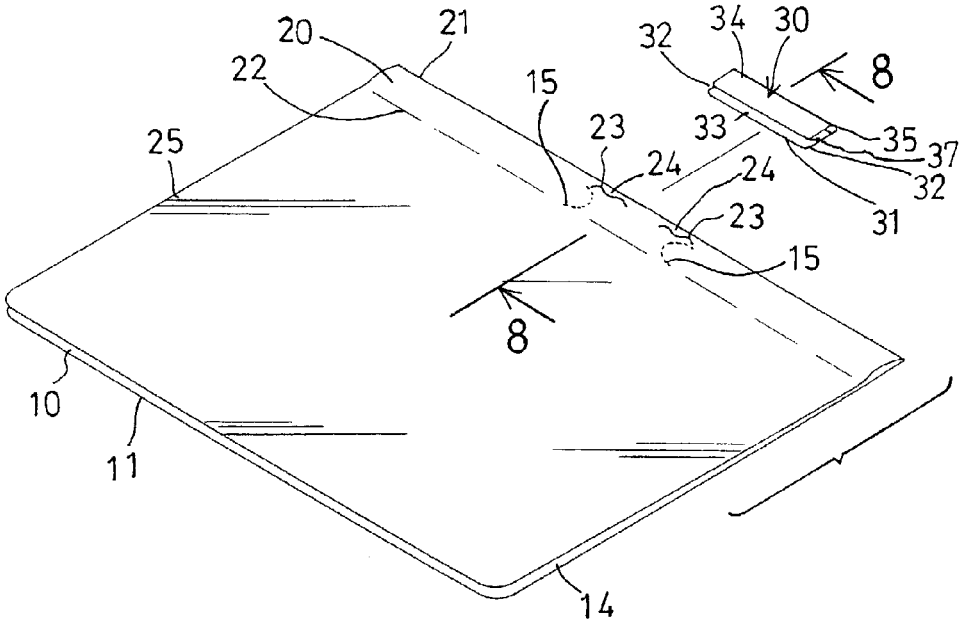
FIG. 2 is an exploded view of the file folder, similar to FIG. 1, in which the file folder is arranged in a closed position.
Figure 3:
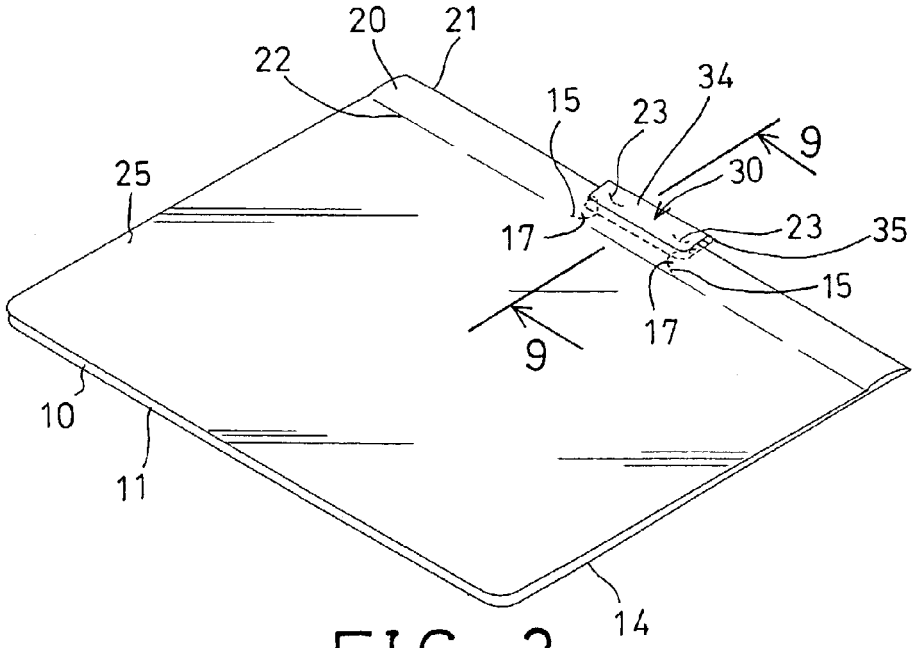
FIGS. 3, 4 are upper perspective views illustrating the operation of the file folder.

Referring to the drawings, and initially to FIGS. 1–8, a file folder in accordance with the present invention comprises a bottom or base sheet 10 including a front edge or portion 11, a rear edge or portion 12, and two side edges or portions 14, and including two curved slits 15 formed in the rear portion 12 thereof and spaced away from each other to form or define two ears 17.

A strip or band or flap 20 is formed on or extended from the rear portion 12 of the base sheet 10, and a hinge line or folding line 21 is formed between the base sheet 10 and the flap 20, for allowing the flap 20 to be folded toward and to engage with the base sheet 10. The flap 20 includes one or more cuts 23 formed therein to form or define a stop 24 each, best shown in FIGS. 1, 2, and 8–10. The stops 24 of the flap 20 are arranged between the ears 17 of the base sheet 10.

A clip 30 includes a base plate 31 having two side portions 32 to be engaged through the slits 15 of the base sheet 10, and arranged between the ears 17 of the base sheet 10. The ears 17 of the base sheet 10 may be engaged onto the side portions 32 of the base plate 31 of the clip 30, so as to stably guide the base plate 31 of the clip 30 to move forwardly and rearwardly relative to the base sheet 10, and to prevent the base plate 31 of the clip 30 from being moved laterally relative to the base sheet 10.

Figure 5:
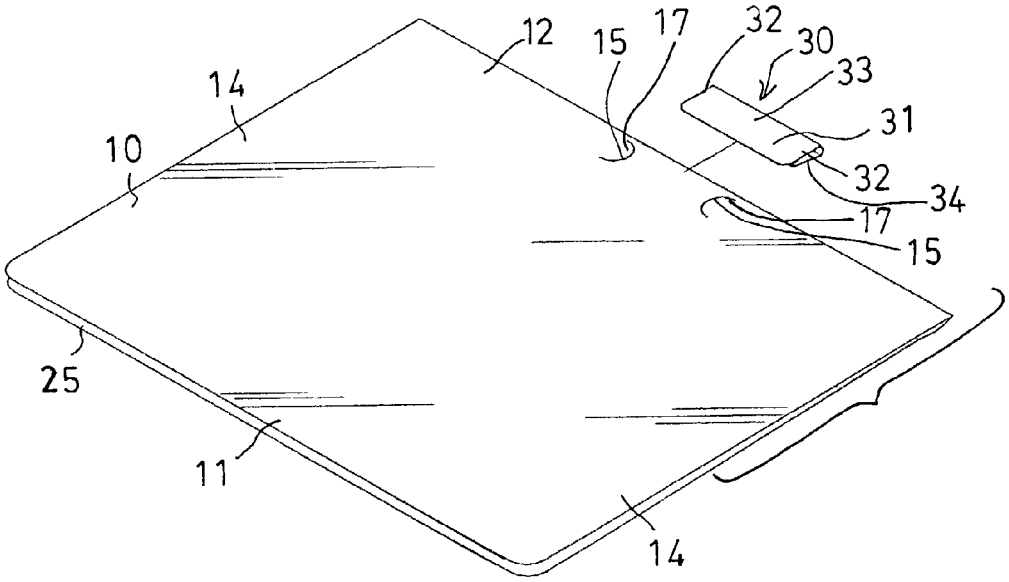
FIG. 5 is an exploded view of the file folder, similar to FIG. 2, as seen from the bottom of the file folder, in which the file folder is also arranged in the closed position.
Figure 4:
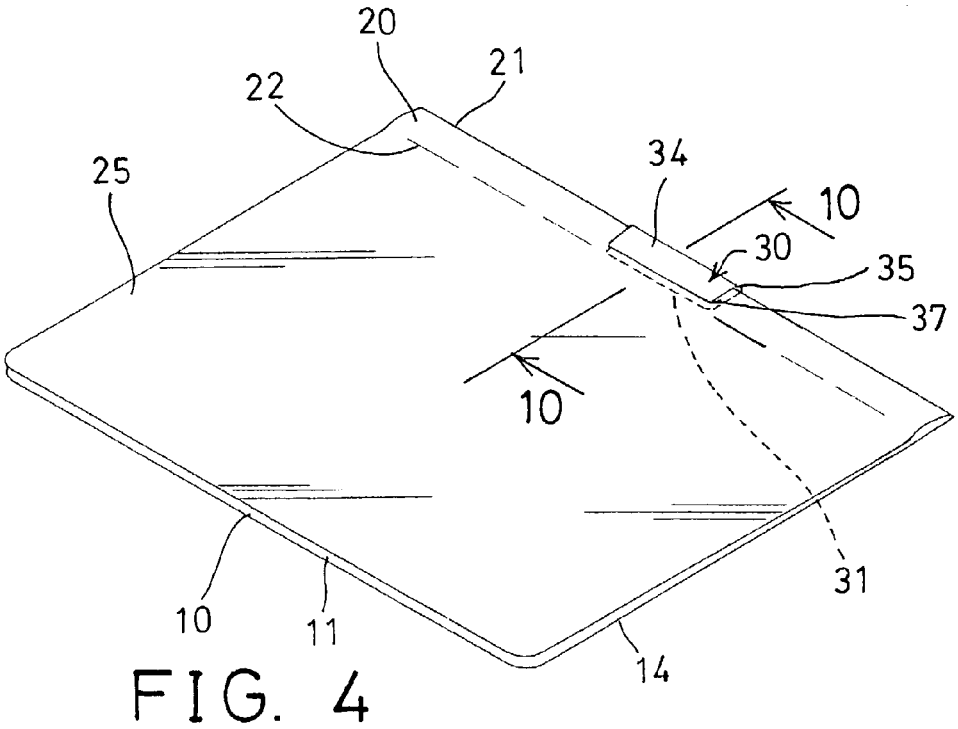
Figure 6:
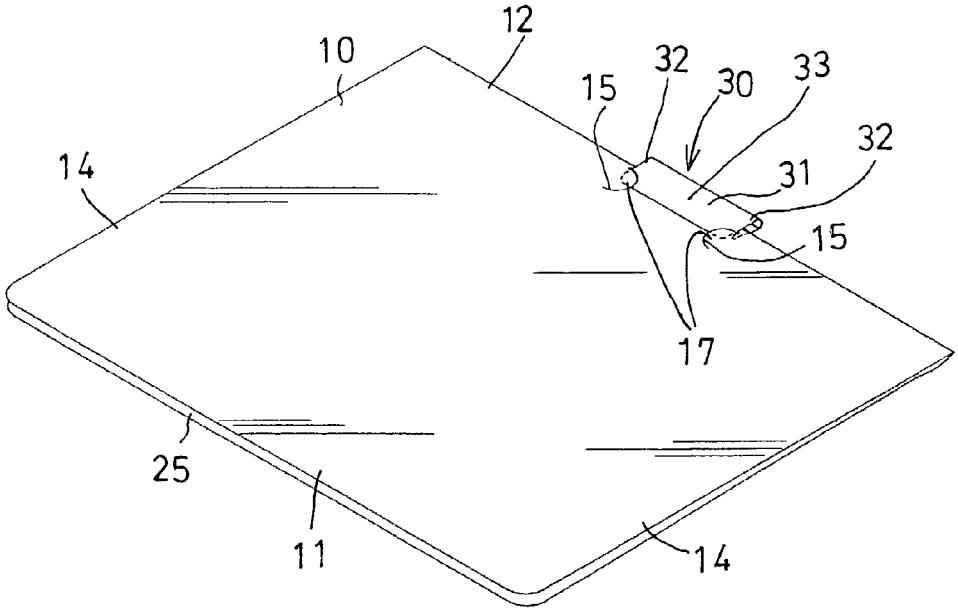
FIGS. 6, 7 are bottom perspective views illustrating the operation of the file folder.
Figure 7:
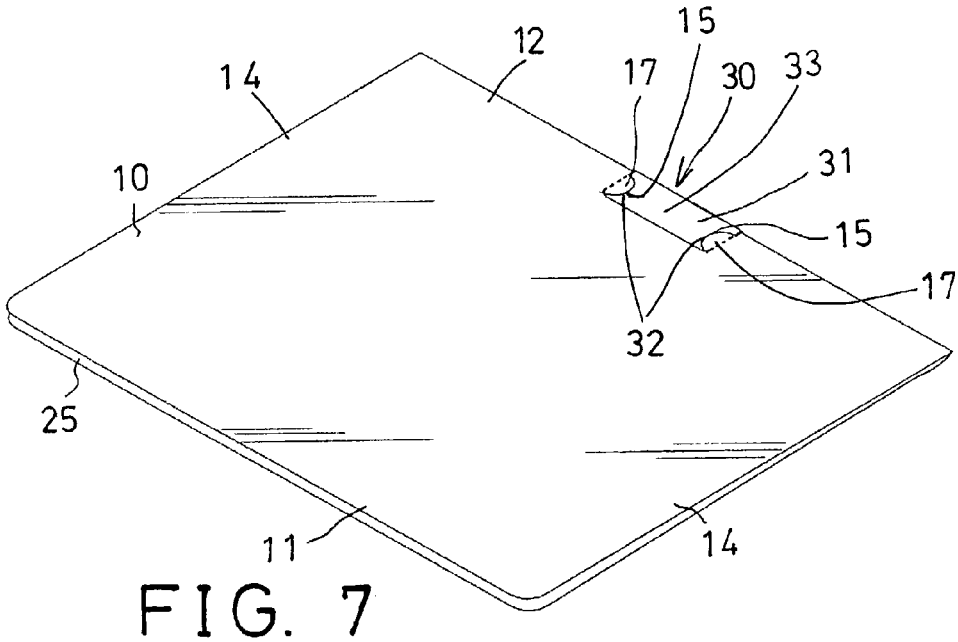

As best shown in FIGS. 5–7, the ears 17 of the base sheet 10 are only engaged onto the side portions 32 of the base plate 31 of the clip 30, and are not engaged onto the middle portion 33 of the base plate 31 of the clip 30, such that the finger(s) of the user may be engaged with the middle portion 33 of the base plate 31, to move the middle portion 33 of the base plate 31 forwardly and rearwardly relative to the base sheet 10. The movement of the clip 30 relative to the base sheet 10 thus will not be interfered by the ears 17 of the base sheet 10.

Figure 8:
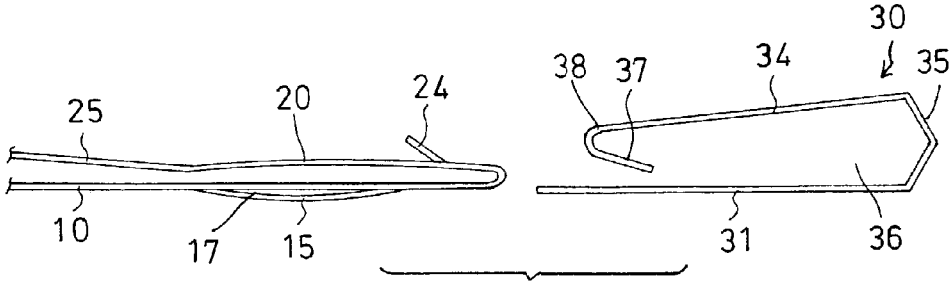
FIGS. 8, 9, 10 are partial cross sectional views taken along lines 8—8, 9—9, 10—10 of FIGS. 2, 3, 4 respectively.
Figure 9:
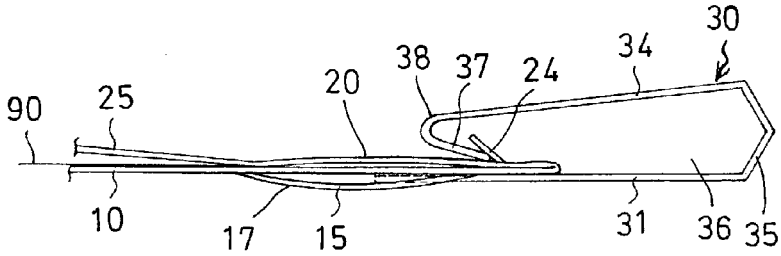
Figure 10:
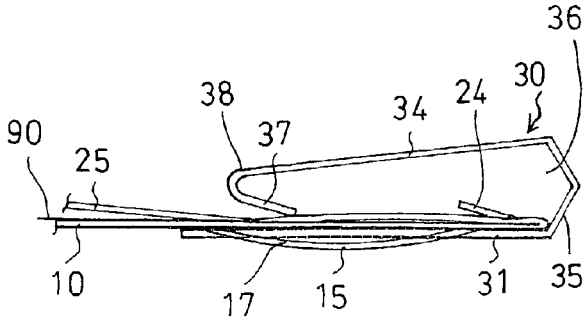
Figure 11:
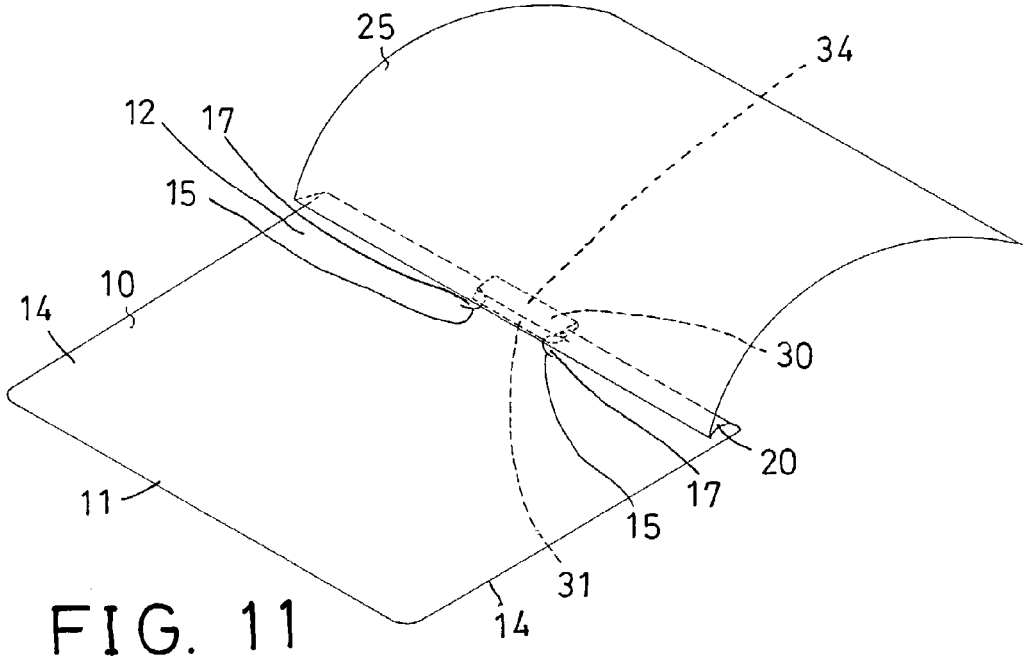
FIGS. 11, 12, 13, 14 are perspective views illustrating the operation of the file folder.
Figure 12:
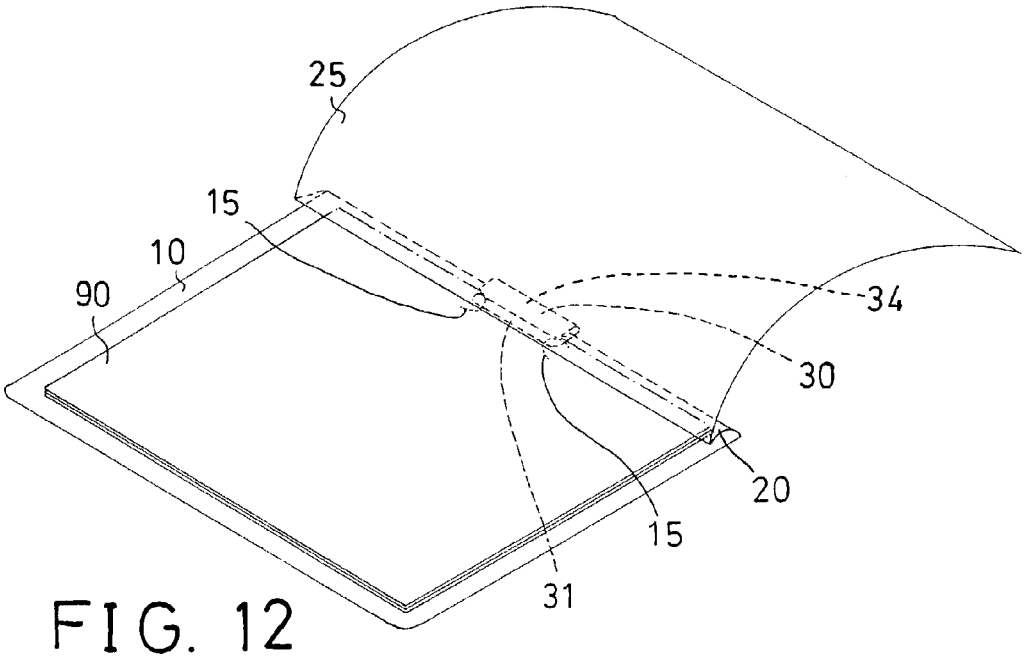
Figure 13:
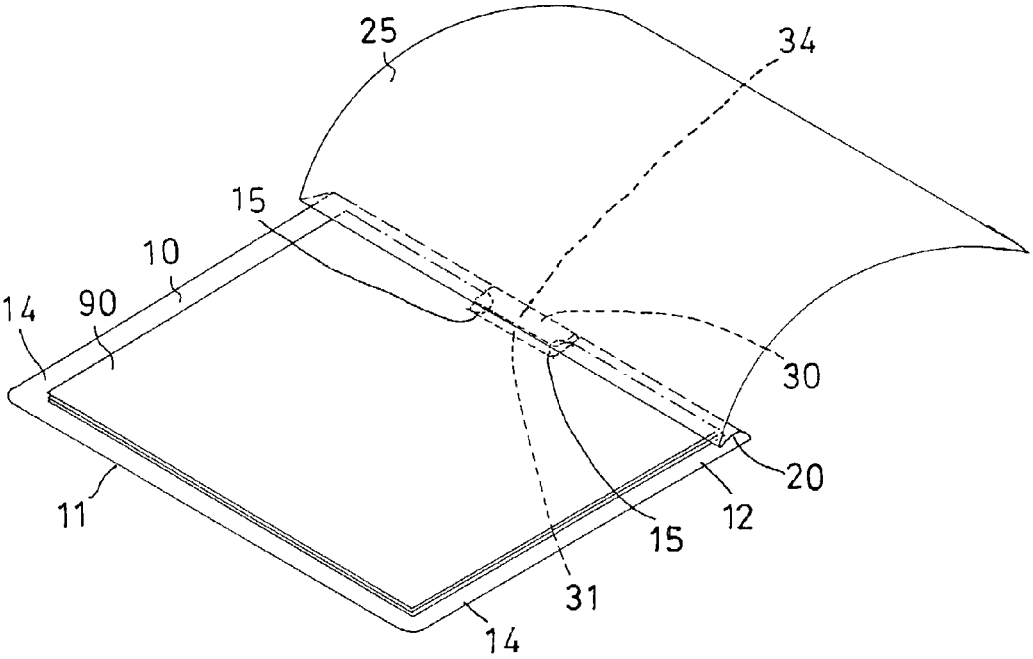
Figure 14:
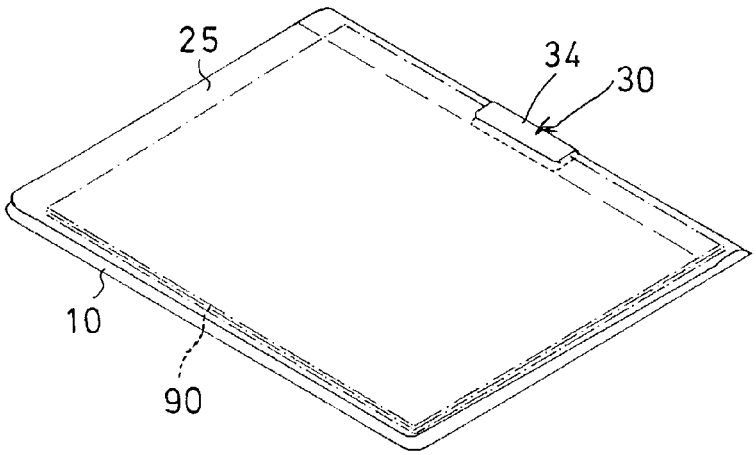

The clip 30 further includes an upper or clamping plate 34 formed or provided above the base plate 31, and a bow member 35 formed or provided between the base plate 31 and the clamping plate 34, to form or define a space 36 between the base plate 31 and the clamping plate 34 (FIGS. 8–10). The clamping plate 34 includes a barb or hook member 37 provided in the front edge or portion 38 thereof and extended inclinedly toward the base plate 31 and toward the bow member 35, for engaging with the stops 24 of the flap 20 (FIGS. 8–10).

As best shown in FIGS. 8–10, the inclinedly extended hook member 37 of the base plate 31 of the clip 30 is arranged for allowing the hook member 37 of the base plate 31 to be easily engaged onto the flap 20 and/or the paper sheets or document 90 to be held or clamped in the file folder, and to be easily engaged over the stops 24 of the flap 20.

In operation, as shown in FIGS. 2–4 and 8–14, the paper sheets or document 90 to be held or clamped in the file folder may first be disposed on the base sheet 10, and the flap 20 may then be folded and engaged onto the paper sheets or document 90 or the rear portion 12 of the base sheet 10, best shown in FIGS. 9 and 10, for allowing the paper sheets or document 90 to be stably retained between the base sheet 10 and the flap 20.

The side portions 32 of the base plate 31 of the clip 30 may then be engaged through the slits 15 of the base sheet 10, and the ears 17 of the base sheet 10 may be engaged onto the side portions 32 of the base plate 31 of the clip 30, to guide the base plate 31 of the clip 30 to move forwardly and rearwardly relative to the base sheet 10, and to prevent the base plate 31 of the clip 30 from being moved laterally relative to the base sheet 10.

The hook member 37 of the base plate 31 may then be easily engaged onto the flap 20 and/or the paper sheets or document 90, and engaged over the stops 24 of the flap 20 by moving the clip 30 toward the base sheet 10 and the flap 20. After the hook member 37 of the base plate 31 has been engaged over the stops 24 of the flap 20, the stops 24 of the flap 20 with the hook member 37 of the base plate 31, and thus may prevent the clip 30 from being disengaged from the base sheet 10 and the flap 20 inadvertently.

It is to be noted that the middle portion 33 of the base plate 31 of the clip 30 has not been blocked or clamped or shielded by the ears 17 of the base sheet 10, such that the finger(s) of the user may be engaged with the middle portion 33 of the base plate 31, to move the middle portion 33 of the base plate 31 forwardly and rearwardly relative to the base sheet 10, without being interfered by the ears 17 of the base sheet 10.

Figure 15:
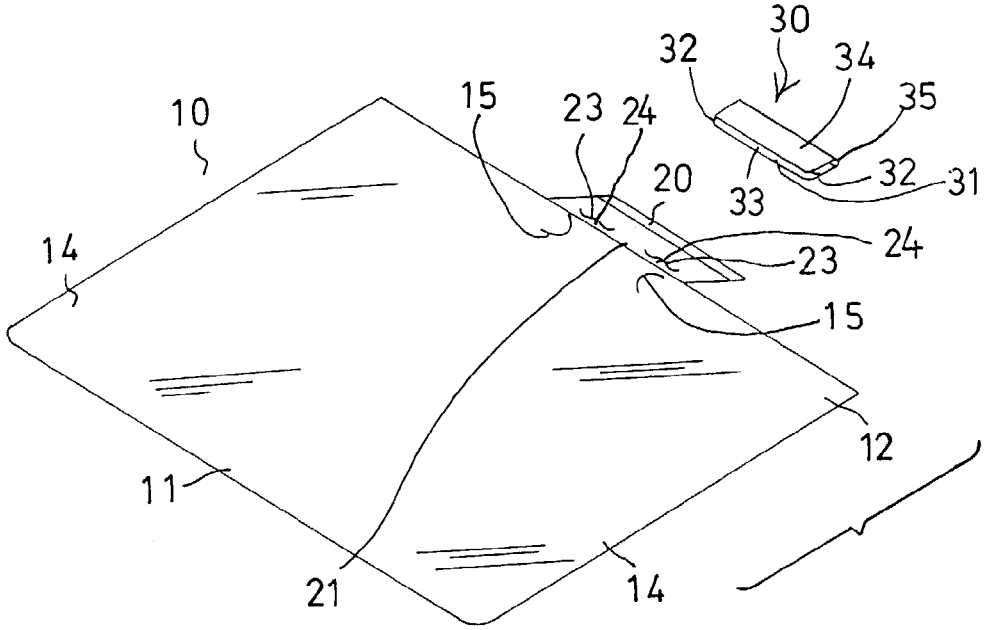
FIG. 15 is an exploded view illustrating the other embodiment of the file folder.
Figure 16:
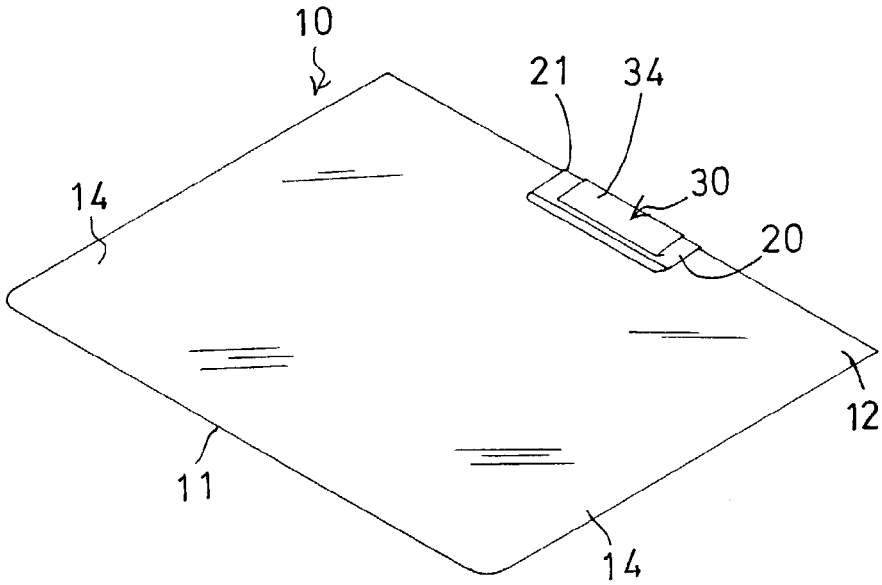
FIG. 16 is an upper perspective view of the file folder as shown in FIG. 15.

The flap 20 may include a length or width equals to that of the base sheet 10 as shown in FIGS. 1–14. However, the flap 20 may also include a length or width smaller than that of the base sheet 10, such as those shown in FIGS. 15–16.

As also shown in FIGS. 1–14, the file folder may further include a cover sheet 25 extended from the flap 20, and may include a hinge line or folding line 22 formed between the cover sheet 25 and the flap 20, for allowing the flap 20 to be folded relative to the cover sheet 25.

Figure 17:
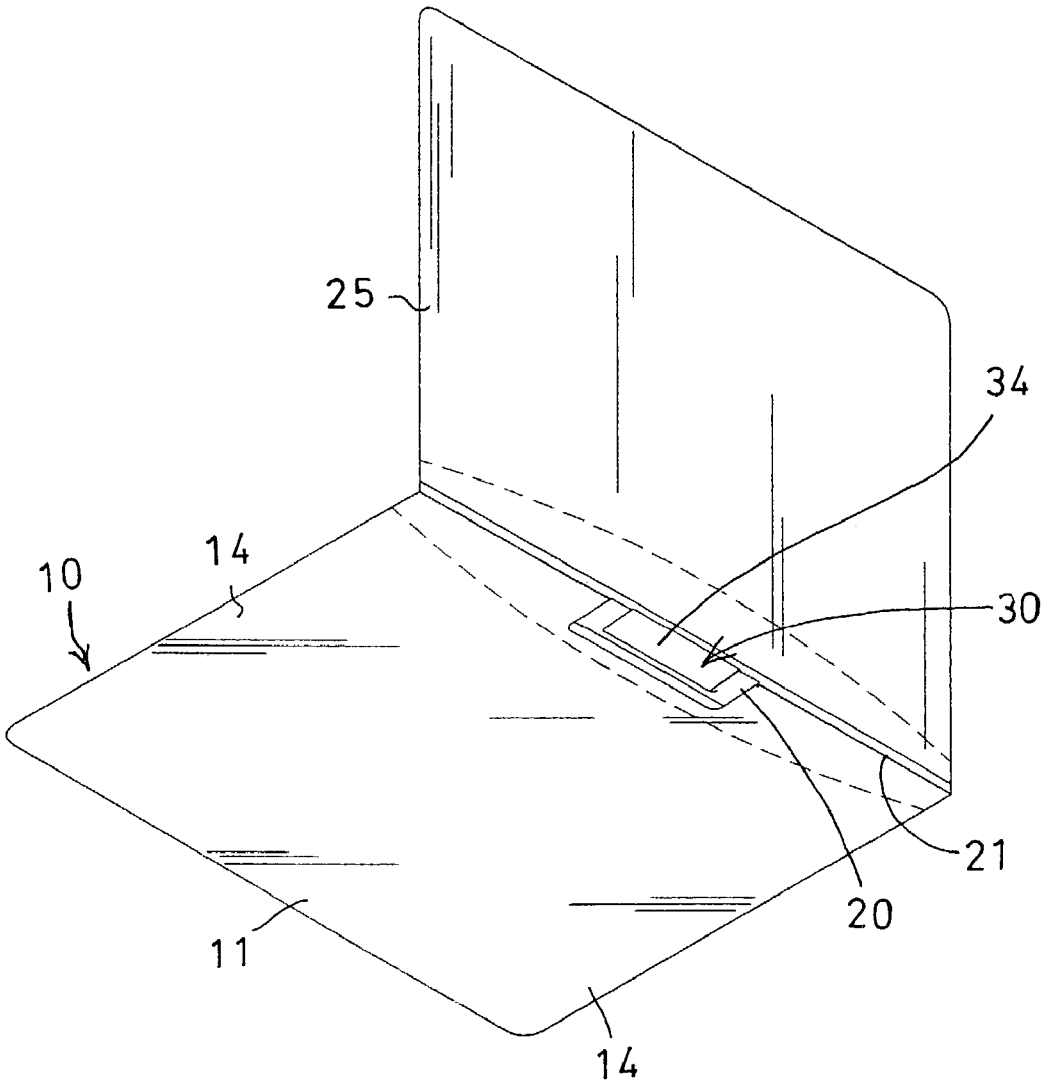
FIGS. 17, 18 are perspective views illustrating the further embodiment of the file folder.
Figure 18:
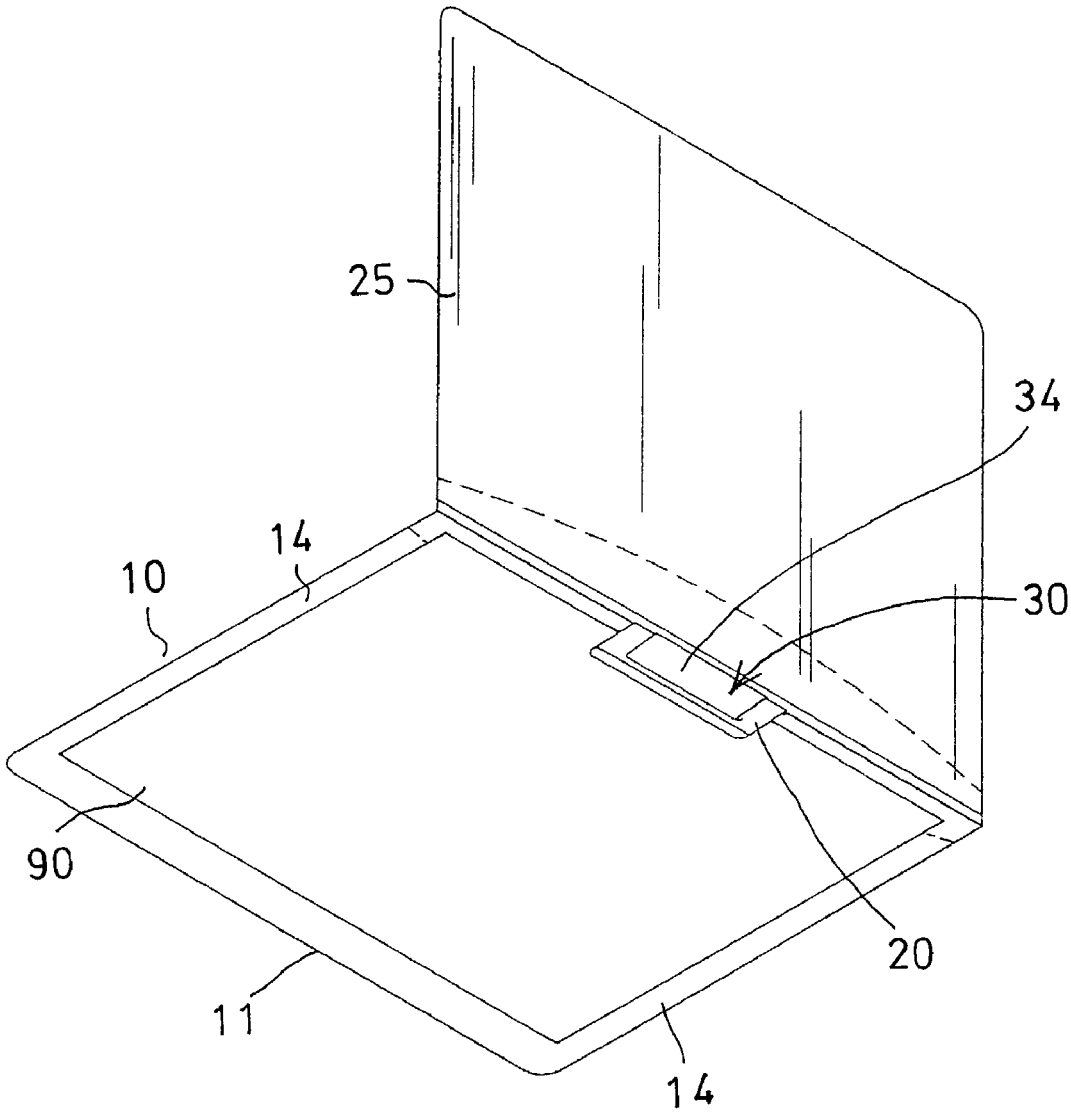

Alternatively, as shown in FIGS. 17 and 18, the cover sheet 25 may also be formed or extended from the base sheet 10, instead of extending from the flap 20, and may have the hinge line or folding line 21 formed between the cover sheet 25 and the base sheet 10, for allowing the cover sheet 25 to be folded relative to the base sheet 10, and for allowing the flap 20 and the clamping plate 34 of the clip 30 to be shielded between the cover sheet 25 and the base sheet 10.

Accordingly, the file folder in accordance with the present invention includes a structure for preventing a clip from being disengaged from the file folder inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A file folder comprising:

a base sheet including a front portion, a rear portion, and two side portions, and including two slits formed in said rear portion thereof and spaced away from each other to form two ears, a flap extended from said rear portion of said base sheet, and including a folding line formed between said flap and said rear portion of said base sheet, to allow said flap to be folded relative to said base sheet, and a clip including a base plate having two side portions engageable through said slits of said base sheet, and arranged between said ears of said base sheet, and including a clamping plate, and a bow formed between said base plate and said clamping plate, said clamping plate including a front portion having a hook member provided thereon, said ears of said base sheet being engaged onto said side portions of said base plate of said clip, to guide said base plate of said clip to move forwardly and rearwardly relative to said base sheet, and to prevent said base plate from being moved laterally relative to said base sheet, and said base plate of said clip including a middle portion arranged between said side portions thereof and between said ears of said base sheet, to allow said clip to be easily moved forwardly and rearwardly relative to said base sheet, and said flap including at least one cut formed therein to form at least one stop therein, and said at least one stop being engageable with said clamping plate of said clip, to prevent said clip from being disengaged from said flap.

2. The file folder according to claim 1 further comprising a cover sheet extended from said flap.

* * * * *